United States Patent [19]

Cannon

[11] 4,195,708

[45] Apr. 1, 1980

[54] WORK CHAIR FOR AERIAL LIFT

[76] Inventor: Charles C. Cannon, 1209 S. Butler, Farmington, N. Mex. 87401

[21] Appl. No.: 947,542

[22] Filed: Oct. 2, 1978

[51] Int. Cl.[2] ..... E04G 1/00

[52] U.S. Cl. ..... 182/2; 182/129; 297/277; 297/349

[58] Field of Search ..... 182/2, 129; 297/277–280, 273, 349

[56] References Cited

U.S. PATENT DOCUMENTS

| | | | |
|---|---|---|---|
| 715,668 | 12/1902 | Kiddie | 297/349 X |
| 2,692,168 | 10/1954 | Gregory | 182/129 X |
| 2,821,312 | 1/1958 | Wiegel | 182/2 |
| 2,845,990 | 8/1958 | Hubert | 297/349 X |
| 3,039,561 | 6/1962 | Edwards | 182/2 |
| 3,039,819 | 6/1962 | Williams et al. | 297/277 |
| 3,203,503 | 8/1965 | Smith et al. | 182/2 |

*Primary Examiner*—Francis K. Zugel
*Attorney, Agent, or Firm*—Edward L. Brown, Sr.

[57] ABSTRACT

The chair is suspended from a elevated aerial ladder and hangs by gravity in a stable manner. The stability enables a worker, such as a sign painter, to be seated while performing his task without being disturbed by tilting and swaying. The stability is due to suspending the chair from a point well above the worker's head which causes the chair to hang stably. The worker can change the direction in which the chair faces by releasing a latch and manually swivelling the chair to a desired direction where he then holds it by reengaging the latch. No power or hydraulic devices are required in achieving the vertical stability nor the swivelling and latching in desired directional position. Therefore the chair is useful on a simple aerial ladder or other type of aerial lift.

2 Claims, 5 Drawing Figures

WORK CHAIR FOR AERIAL LIFT

BACKGROUND OF THE INVENTION

This invention pertains to an aerial lift that supports a worker and more particularly to an aerial work chair that stably supports a seated worker from the lift. The invention is particularly for use of a sign painter working on an elevated sign.

In the prior art there are baskets to support a standing worker from an aerial lift and U.S. Pat. Nos. 3,605,941 and 3,695,390 show a basket with a folding seat, inside the basket, positioned so that arms of the worker are at same elevation whether he is standing or sitting, that is, his forearms can rest on rim of the basket in either case. Horizontal pivots are located at the rim or below it which places the pivots close to center of gravity of suspended load. This causes the basket to tilt abruptly whenever the worker leans or shifts his weight. Unless he has a hold on a steadying object, this abrupt tilt interferes with his work. In order to avoid this, a positive leveling means is usually added to baskets used on electric lines.

Aerial supports in common use in the sign painting field, other than ladders and staging, are baskets suspended from aerial ladders or other types of aerial lifts but without leveling means because of their added expense. Therefore the average sign painter has to work standing up in an easily tilted basket while aloft and with nothing to grab hold of to steady the basket. The utility of the work chair is in providing a stable and comfortable working position for a sign painter.

SUMMARY OF THE INVENTION

The gist of the invention is using a chair instead of a basket and suspending it from a horizontal pivot located well above the seated worker's head, instead of near his waist, to achieve stability by gravity alone, and provide freedom for the worker to swivel and clamp the chair to face in any direction of a full 360 degree circle. Also particularly to provide this utility at a reasonable cost without complicated and costly stabilizing means. The stability against tilting is due to raising the horizontal pivot from a level near the seated worker's waist to a level several feet above his head thus causing the chair with the seated worker to hang in a stable manner and eliminating a feeling of impending capsizing that he has in a basket without positive leveling or other stabilizing means. The feeling of stability is also improved in the chair, compared to the basket, because the greater distance between the pivot and the center of gravity increases length of pendulum and slows it swing. The inventive concept of the chair differs from that shown in the two U.S. Pat. Nos. 3,605,941 and 3,695,390 in several ways, among them the following:

(a) it is a chair rather than a basket;

(b) the chair is supported from a horizontal pivot located on vertical axis through center of gravity of the chair and the worker, the pivot being located well above head of the worker rather than below his head at rim of the basket as in prior art.

(c) the chair achieves stability by increasing distance between the horizontal pivot and the center of gravity of suspended load rather than by "a positive leveling system or, . . . a hydraulic cylinder for damping the free swinging motion of the workman's basket" described in U.S. Pat. No. 3,695,390, a column 5, line 25–27 or by "means . . . in the form of a hydraulic shock absorber . . . to dampen motion of the basket" described in U.S. Pat. No. 3,605,941, column 4, lines 55–59.

(d) the chair can rotate 360 degrees to any desired aspect rather than "substantially greater than 90 degrees" limit on the basket described in U.S. Pat. No. 3,605,941, column 2, lines 35–36.

(e) the chair has a convenient means, the aspect ring, for manually rotating the chair from any aspect to any desired aspect whereas the bracket supporting the basket in the aforementioned patents is difficult to reach at some aspects because it is then located behind the seated workers back.

An object of the invention is to provide a stable work chair for an aerial lift at a reasonable cost.

Another object of the invention is to substitute the force of gravity for a positive leveling system.

Another object of the invention is to provide an aerial work chair that can be easily turned and fixed in any direction by the seated worker.

Another object of the invention is to provide sign painters working aloft with practical and attainable safe working conditions.

Another object of the invention is to provide an aerial work chair that can serve as a complete and comfortable workshop for a sign painter that enables him to accomplish more work.

DESCRIPTION OF THE PREFERRED EMBODIMENT

Figure 1:
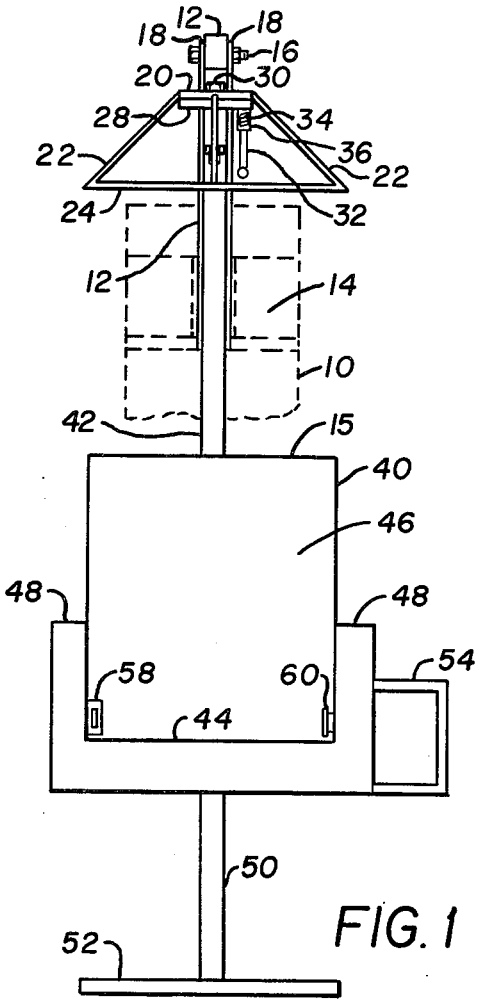
FIG. 1 is a front elevational view of an aerial work chair embodying the invention.
Figure 2:
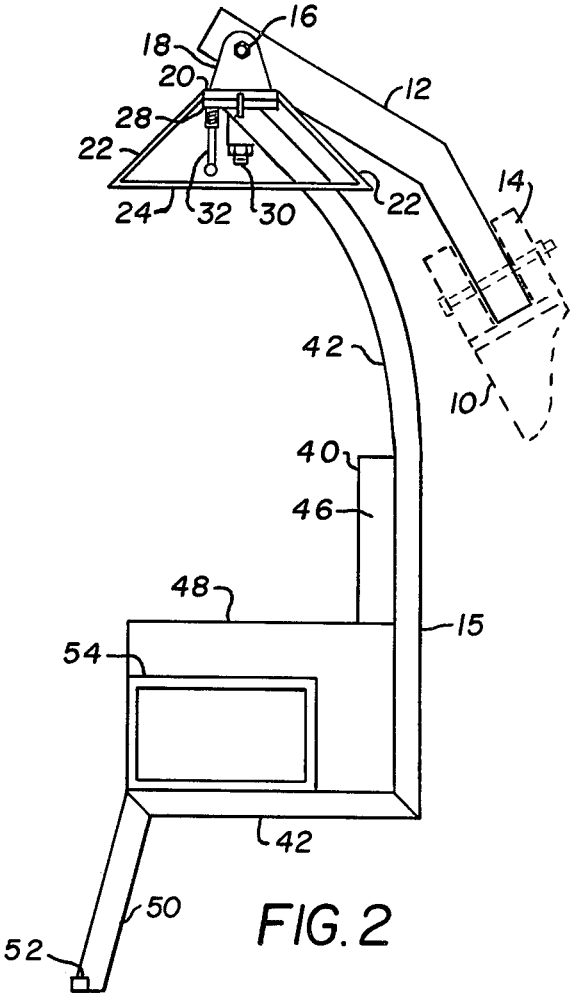
FIG. 2 is a side elevational view of the chair showing how it is suspended from an aerial lift.
Figure 3:
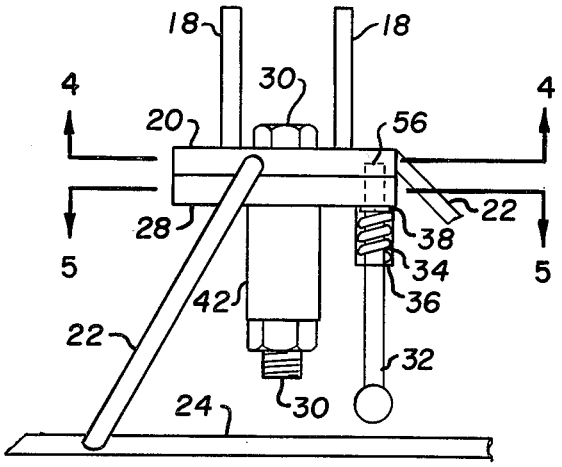
FIG. 3 is an enlarged view of a part of FIG. 1 showing details of rotation about vertical axis and latching into position.
Figure 4:
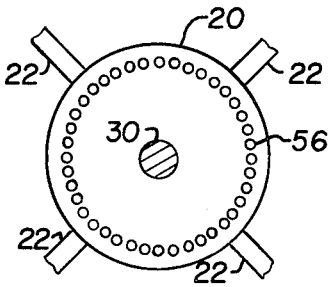
FIG. 4 is a sectional view along the line of 4—4 of FIG. 3.
Figure 5:
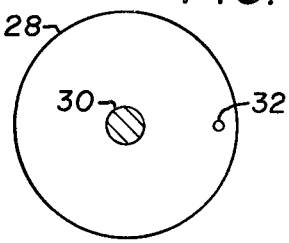
FIG. 5 is a sectional view along the line 5—5 of FIG. 3.

Referring now to FIGS. 1 and 2, the preferred embodiment of this invention, and the manner and process of making and using it, will be described in such a way that any skilled person will be able to make and use it.

A bracket 12 is fastened to a boom 10 by an attachment means 14. The boom 10 is that of an aerial lift, not shown. The aerial lift is a conventional piece of mobile equipment having means for moving the outer end of the boom 10 up or down, in or out, and in a horizontal circle. The boom 10 may be a simple member or a ladder. In a prototype of the invention, a work chair 15 has been suspended from a boom 10 consisting of a ladder on a mobile aerial ladder unit which is in common use in the sign painting industry. The bracket 12 is elongated and has a downward bend to provide clearance for the work chair 15 when the boom 10 is at its closest to vertical operating angle as can be seen in FIG. 2. A horizontal pivot 16 connects outer end of the bracket 12 to a clevis 18 which is attached to and supports a stationary aspect plate 20. One or more aspect ring supports 22 extend downward and outward from the stationary aspect plate 20 to an aspect ring 24. A rotatable aspect plate 28 is just below, adjacent to, and supported from the stationary aspect plate 20 by a vertical pivot 30 that permits the rotatable aspect plate 28 to rotate freely in a horizontally plane to any degree.

A chair 40 is supported by a chair support 42 attached to underside of the rotatable aspect plate 28 directly above center of the chair 40. The chair support 42 extends downward obliquely and then vertically to pass behind a back 46 of the chair 40. The chair support 42 then turns to a horizontal direction and passes under, from back to front, a seat 44 of the chair 40. The seat 44 is attached to and supported by the chair support 42. The seat 44 in turn supports the chair 40 and a seated worker. A pair of arms 48 on sides of the chair 40 are supported by the seat 44. A rack 54 for holding work materials and tools of the seated worker is attached to one or both sides of the chair 40 and supported by the arm 48 and the seat 44. A foot rest support 50 is fastened to front end of the chair support 42 at front of the seat 44 and extends downward to the level of the seated worker's feet. At this point a foot rest 52 is fastened to the foot rest support 50 and extends transversely parallel to and below the front of the seat 44 at a level to provide a comfortable support for the seated worker's feet.

Aspect, when used in this application, refers to direction in which the work chair 15 faces. The work chair 15 is rotatable about the vertical pivot 30 to any aspect the seated worker desires. The chair 40, being fastened through the chair support 42 to the rotatable aspect plate 28, can rotate about the vertical pivot 30 while the stationary aspect plate 20 remains stationary with regard to the boom 10. The aspect ring 24 is also stationary and located a short distance above the seated worker's head but within easy reach of his arm. An aspect latch pin 32 is vertically slidable through a point near outer rim of the rotatable aspect plate 28 and is able to extend upward into one of a multiplicity of sockets 56 in the stationary aspect plate 20. The latch pin 32 extends downward to near the level of the aspect ring 24 where it is within reach of the seated worker. The latch pin 32 has a spring follower 38 fastened to it just below the rotatable aspect plate 28. A latch spring 34 surrounds the latch pin 32 and is confined in a spring cage 36 that is fastened to the rotatable aspect plate 28. The latch spring 34 thrusting upward against the spring follower 38 biases the latch pin 32 upwards to that it will enter whichever of the sockets 56 with which it is aligned after the latch pin 32 is released. A seat belt having a belt buckle 58 and a belt latch 60 is attached to the chair 40.

In operation, the worker maneuvers the chair 40 to a position near the ground, loads his tools and work materials in the rack 54, sits down in the chair 40 and buckles the belt buckle 58 to the belt latch 60. Using a conventional control and method, he raises, extends, and rotates the boom 10 to desired working position. The worker then pulls down the latch pin 32 and grabbing the aspect ring 24 swivels the chair 40 to the aspect he wishes and releases the latch pin 32 which enters the nearest socket 56 and holds the chair in that aspect until it is changed. There is no effort required to keep the work chair 15 hanging in a stable manner because the horizontal pivot 16, being well above the workers head, is an appreciable distance above the center of gravity of the suspended load which is near the seat 44. This causes the work chair 15 to hang vertically and when displaced, return slowly to its vertical position with no disturbing motions.

I claim:

1. A chair having a seat, a back, a pair of arms, and a rack attached to one of the arms for holding tools and work materials, the chair stably suspending and positioning a signpainter by gravity and manual means only, from a mobile, rotatable and extendible aerial ladder, comprising:

a bracket mounted to outer end of the aerial ladder and projecting outward;

a horizontal pivot mounted on outer end of the bracket;

a stationary aspect plate suspended from and free to swing from the horizontal pivot, the plate having a multiplicity of recesses equidistant from center of the plate for use in positioning the chair in a desired fixed aspect;

a vertical pivot mounted to and below the center of the stationary aspect plate;

a rotatable aspect plate, adjacent to and beneath the stationary aspect plate, suspended on the vertical pivot and free to rotate about it in a complete 360 degree circle;

means for latching the rotatable aspect plate to one of the recesses in the stationary aspect plate for holding the chair in the desired aspect;

a chair support mounted to the rotatable aspect plate, above and well clear of head of the signpainter, and extending downwardly at an angle with the vertical to a point behind the seated worker at level of his head, thence vertically downward along the chair back, thence horizontally forward under the chair seat which is mounted on the chair support at such a location that centers of gravity of the chair and of the seated worker are vertically beneath the horizontal pivot when the chair is suspended in a normal position thus providing a stable suspension of the worker;

a foot rest support mounted to the chair support and extending downward to a point beneath from of the chair seat at foot level of the seated worker; and a foot rest mounted horizontally at bottom of the foot rest support and beneath the front of the chair seat, and an aspect ring mounted to the stationary aspect plate, extending outward from the plate at a lower elevation than the plate, above and clear of the signpainter's head but within convenient reach of his hand when changing the aspect of the chair about the vertical pivot.

2. A chair as recited in claim 1 further comprising a safety belt attached to the chair for securing the seated worker.

* * * * *